US008382096B2

(12) United States Patent
Suito et al.

(10) Patent No.: US 8,382,096 B2
(45) Date of Patent: Feb. 26, 2013

(54) SHEET PACKAGE

(75) Inventors: Yoshikatsu Suito, Nagoya (JP); Kiyoichi Ohta, Nagoya (JP); Yasunori Nakamura, Toyokawa (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 168 days.

(21) Appl. No.: 12/817,643

(22) Filed: Jun. 17, 2010

(65) Prior Publication Data

US 2010/0326861 A1 Dec. 30, 2010

(30) Foreign Application Priority Data

Jun. 29, 2009 (JP) ..... 2009-154407

(51) Int. Cl.
*B65H 1/00* (2006.01)
*B65D 85/48* (2006.01)

(52) U.S. Cl. ..... 271/145; 206/449; 206/453; 206/455

(58) Field of Classification Search ..... 271/145, 271/162; 206/449, 453, 455
See application file for complete search history.

(56) References Cited

U.S. PATENT DOCUMENTS

| | | | | |
|---|---|---|---|---|
| 7,789,232 | B2 * | 9/2010 | Suito et al. | 206/449 |
| 8,016,285 | B2 * | 9/2011 | Horiuchi et al. | 271/145 |
| 2005/0230902 | A1 * | 10/2005 | Sugiyama et al. | 271/114 |
| 2006/0012110 | A1 * | 1/2006 | Yamamoto et al. | 271/145 |
| 2008/0099359 | A1 * | 5/2008 | Suito et al. | 206/449 |
| 2008/0187386 | A1 * | 8/2008 | Horiuchi et al. | 400/624 |

FOREIGN PATENT DOCUMENTS

| | | | |
|---|---|---|---|
| EP | 1932675 | A1 | 6/2008 |
| EP | 1950047 | A2 | 7/2008 |
| JP | 2009113815 | | 5/2009 |

* cited by examiner

*Primary Examiner* — Luis A Gonzalez
(74) *Attorney, Agent, or Firm* — McCarter & English, LLP

(57) ABSTRACT

A sheet package for supplying sheets to a printing apparatus has stacked sheets, and a package member that includes a first flat surface portion covering the sheets, a first side face portion extended from the first flat surface portion, a second flat surface portion extended from the first side face portion, a second side face portion extended from the first flat surface portion, a third flat surface portion extended from the second side face portion, a first cut-out portion formed in the first flat surface portion, a second cut-out portion formed in the second flat surface portion, and a third cut-out portion formed in the third flat surface portion, wherein at least one of an end of the second cut-out portion and an end of the third cut-out portion is disposed more toward the opposite side of the transfer direction of sheets than an end of the first cut-out portion.

9 Claims, 19 Drawing Sheets

SHEET PACKAGE

CROSS-REFERENCE TO RELATED APPLICATION

This Application claims priority from JP2009-154407, filed on Jun. 29, 2009, the content of which is hereby incorporated by reference.

BACKGROUND

The present disclosure relates to a sheet package. More particularly, the disclosure relates to a sheet package that protects the outside of stacked sheets of paper with a package member and that allows the sheets to be accommodated into a printing apparatus with the package member.

Conventionally, sheet packages containing stacked sheets of paper in a box-like package member for use in printing apparatus are known. When using sheets of this sheet package for printing, the user opens a lid part of the package member, folds it back in the opposite direction, and inserts an insertion portion formed at the distal end of the lid part into a cut portion formed in the surface of the package member to retain the lid part. The sheet package thereby assumes a state in which part of the sheets is exposed. With the sheet package in this state, the sheet package is accommodated into a printing apparatus with the package member and used. This sheet package allows the user to collectively handle multiple sheets of paper on a package-by-package basis and provides convenient use. As the sheets inside are covered and can be protected by the package member, this sheet package is particularly useful when thermal sheets that are susceptible to light and heat are employed.

The sheet package mentioned above has a box-like shape, with a rectangular first flat surface portion covering a surface on one side in a stacking direction of the sheets, in which a second cut-out portion is formed in a side edge. A second flat surface portion, or an upper part, opposite the first flat surface portion, covering the other surface on the opposite side in the stacking direction of the sheets, is also formed with a first cut-out portion at a position opposite the second cut-out portion. The printing apparatus in which this sheet package is used detects presence or absence of sheets by emitting light from a reflection type optical sensor through the first and second cut-out portions. The second flat surface portion of the sheet package is pressed by the lid of the printing apparatus, and therefore when the sheet package runs out of sheets, the second flat surface portion deflects toward the first flat surface portion.

SUMMARY

However, in the above-described sheet package, as shown in FIG. 19, when there is no paper inside the sheet package 9, the light emitted from the reflective optical sensor 80 is not reflected by paper and diffused. There is thus a problem that it is sometimes decided that there is still paper, when the light that has passed through the first cut-out portion 451 is reflected by the backside around the second cut-out portion 53 of the second flat surface portion 50, or when the light passed through the first cut-out portion 451 and second cut-out portion 53 is reflected by the backside of a third flat surface portion 60 that retains the second flat surface portion 50.

To solve the above problem, the present disclosure has been developed, and it is an object of the present disclosure to provide a sheet package that can prevent erroneous detection of presence or absence of paper.

To solve the above problem, in an aspect of this disclosure, a sheet package to be accommodated in a printing apparatus for supplying sheets as print media to the printing apparatus, including stacked sheets, and a package member that includes, at least a rectangular first flat surface portion covering at least part of a surface on one side in a stacking direction of the stacked sheets, a rectangular first side face portion foldably extended from a side edge of the first flat surface portion, and covering a side face of the stacked sheets, a rectangular second flat surface portion foldably extended from an end portion of the first side face portion on an opposite side of a connecting portion between the first side face portion and the first flat surface portion such as to face the first flat surface portion and covering another surface on the opposite side of the surface on one side in the stacking direction of the stacked sheets, a rectangular second side face portion foldably extended from an end portion of the first flat surface portion on an opposite side of the end portion and covering a side face of the stacked sheets, a third flat surface portion foldably extended from an end portion of the second side face portion on an opposite side of a connecting portion between the second side face portion and the first flat surface portion and formed with an insertion portion to be inserted into a cut portion provided in the second flat surface portion, a rectangular third side face portion foldably extended from a side edge of the first flat surface portion on an opposite side of a direction in which sheets are transferred to the printing apparatus and covering an end face on the opposite side of the transfer direction of the stacked sheets, a first cut-out portion formed in the first flat surface portion at an end portion on an opposite side of the connecting portion between the first flat surface portion and the first side face portion, through which light from an optical sensor disposed opposite the first flat surface portion is passed for detecting presence or absence of the sheets, a second cut-out portion formed in the second flat surface portion at a position opposite the first cut-out portion, through which the light from the optical sensor is passed; and a third cut-out portion formed in an end portion on a side of the first cut-out portion of the third flat surface portion, wherein at least one of an end portion on the opposite side of the transfer direction of sheets of the second cut-out portion and an end portion on the opposite side of the transfer direction of sheets of the third cut-out portion is disposed more toward the opposite side of the transfer direction of sheets than an end portion on the opposite side of the transfer direction of sheets of the first cut-out portion.

BRIEF DESCRIPTION OF THE DRAWINGS

Exemplary embodiments of the disclosure will be described below in detail with reference to the accompanying drawings in which.

DETAILED DESCRIPTION OF THE EXEMPLARY EMBODIMENTS

Figure 1:
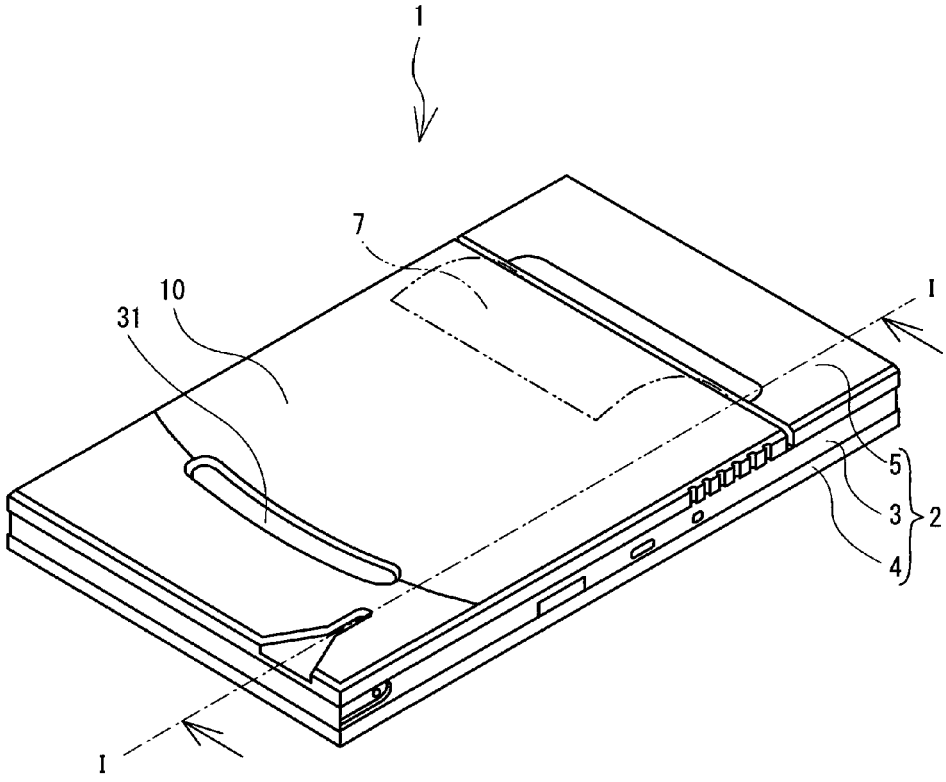
FIG. 1 is a perspective view of a printing apparatus.

The structure of a printing apparatus 1, in which a sheet package 9 that is a first embodiment of the present disclosure is to be placed, will be described with reference to FIGS. 1 to 4. As shown in FIG. 1, the printing apparatus 1 has a flat parallelepiped shape, being rectangular in plan view (slightly larger than A6 size) and having a thickness of about 2 cm. The printing apparatus 1 has a main body case 2 includes a frame 3, a lower cover 4, an upper cover 5, a cover portion 10, and the like. The frame 3 is rectangular in plan view. The lower cover 4 is rectangular in plan view and covers the underside of the frame 3. The upper cover 5 covers part of the upper side of the frame 3. The cover portion 10 is rectangular in plan view. Here, the lower left direction of FIG. 1 is referred to as the rear side of the printing apparatus 1, while the upper right direction of FIG. 1 is referred to as the front side of the printing apparatus 1.

Figure 2:
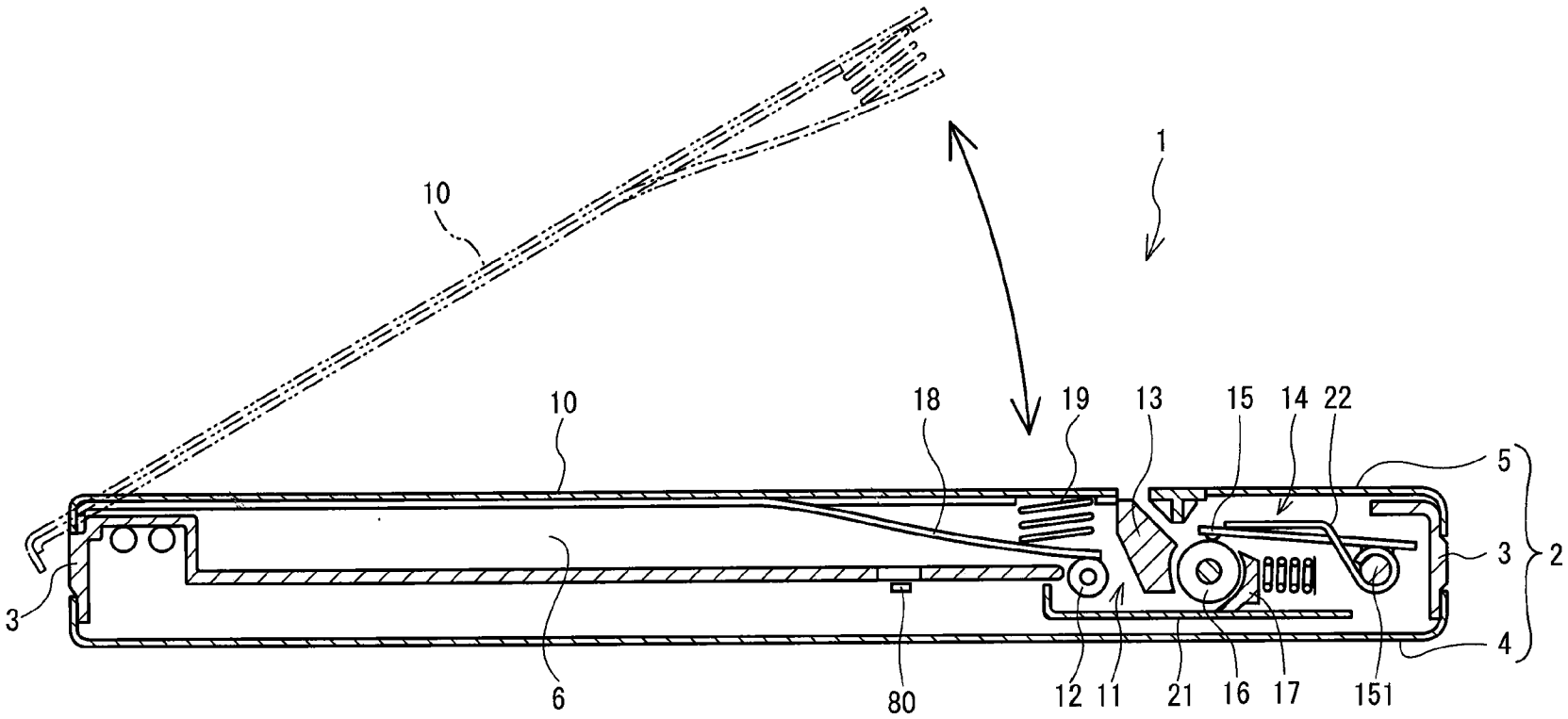
FIG. 2 is a cross-sectional view taken along the line I-I in FIG. 1 viewed from the direction of arrows.
Figure 3:
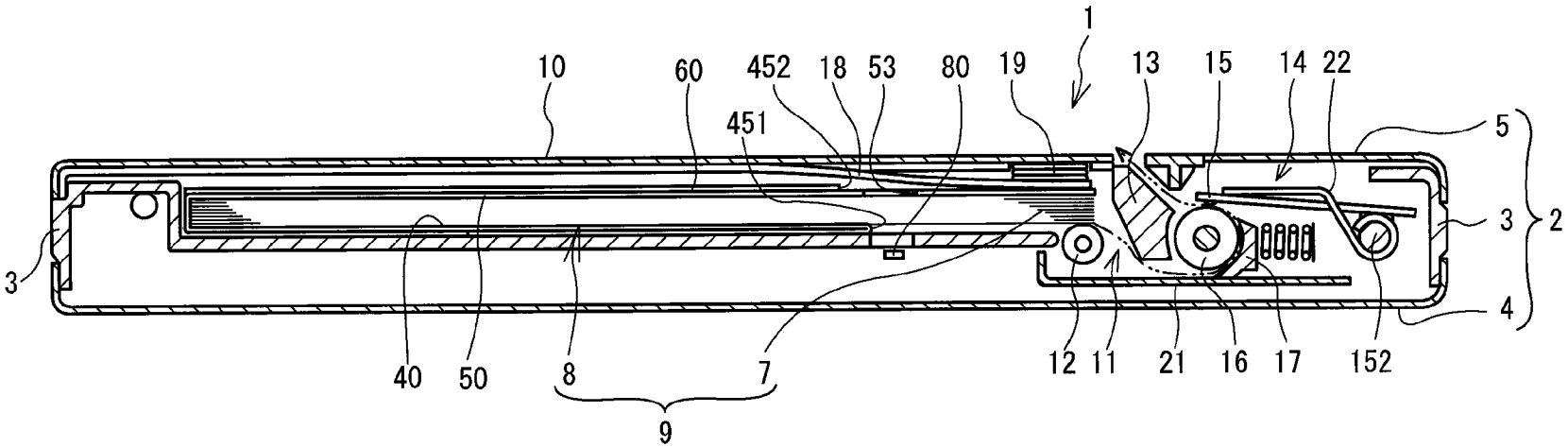
FIG. 3 is a view showing a state in which a sheet package is set in a paper accommodating part.

As shown in FIGS. 2 and 3, a printing mechanism 14 is disposed at one end portion inside the printing apparatus 1 (on the right side in FIGS. 2 and 3). The upper side of the printing mechanism 14 is covered by the upper cover 5 which is rectangular in plan view. The printing mechanism 14 includes a thermal head 15, a platen roller 16, and a paper guide 17. A paper containing portion 6 is formed on the upper side of the frame 3 in a part that is not covered by the upper cover 5. The upper side of the paper containing portion 6 is covered by the cover portion 10 thereabove. The cover portion 10 is freely opened and closed as shown in FIG. 2.

As shown in FIG. 3, the paper containing portion 6 can accommodate the sheet package 9. The sheet package 9 stores a plurality of sheets 7, which are A6 or A7 size cut sheets of thermal paper, inside a package member 8. A lock mechanism (not shown) is provided on the side of the main body case 2. This lock mechanism can retain the cover portion 10 in its closed position as shown in FIG. 3, with the sheet package 9 being set in the paper containing portion 6. As shown in FIG. 1, near the rear end of the cover portion 10, a peephole 31, opened in a circular arc shape, is formed in a predetermined length in a direction orthogonal to the longitudinal direction of the cover portion 10. The user can see the sheet package 9 accommodated in the paper containing portion 6 through the peephole 31.

Figure 4:
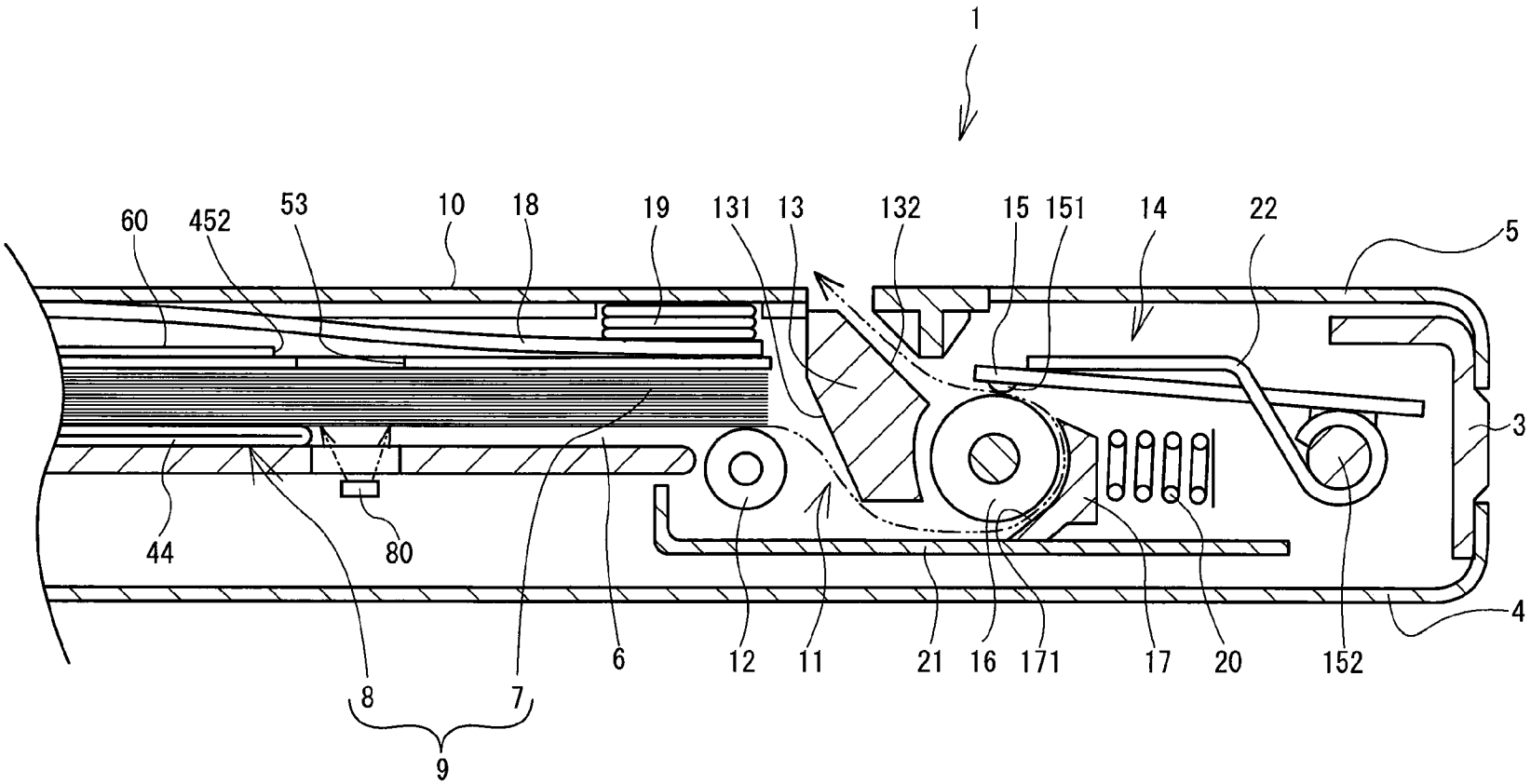
FIG. 4 is an enlarged cross-sectional view showing the details of a sheet separation part and a printing mechanism.

As shown in FIG. 4, a sheet separation part 11 is provided at one end of the paper containing portion 6 on the side of the printing mechanism 14. The sheet separation part 11 includes a pickup roller 12 and a separation block 13. A pressing plate 18 is rotatably supported on an inner side of the cover portion 10, i.e., on the side facing the paper containing portion 6. A coiled bias spring 19 is interposed between the pressing plate 18 and the cover portion 10. The bias spring 19 constantly applies a biasing force to the pressing plate 18 in a downward direction in FIG. 4 (direction toward the pickup roller 12).

The sheets 7 are stored inside the sheet package 9 in a stacked state with the printing surface facing down. The sheet package 9 is accommodated in the paper containing portion 6 with the underside of a lowermost sheet 7 stored in the sheet package 9 being partly exposed from the package member 8. When the sheet package 9 is accommodated in the paper containing portion 6 and the cover portion 10 is closed and retained, the pressing plate 18 that is biased downwards by the biasing spring 19 presses the sheets 7 through the package member 8 so that the exposed part of the sheet 7 is pressed toward the pickup roller 12 to bring the underside of this sheet 7 into contact with the pickup roller 12.

As shown in FIG. 4, the separation block 13 is provided in close proximity and opposite the pickup roller 12. The separation block 13 includes a separation guide surface 131 inclined relative to a paper feed-out direction of the pickup roller 12. In the sheet separation part 11 with the above structure, as the pickup roller 12 is driven to rotate, it applies a friction transfer force to the lowermost sheet of paper 7 in contact with the pickup roller 12. The friction transfer force separates only one lowermost-positioned sheet 7 and feeds it out in cooperation with a separating function of the separation guide surface 131 of the separation block 13.

The printing mechanism 14 will be described. As shown in FIG. 4, on the opposite side of the pickup roller 12, with the separation block 13 therebetween, the platen roller 16 is provided such as to be rotatable by a motor (not shown). The paper guide 17 is disposed in close proximity to an outer circumferential surface of the platen roller 16. The paper guide 17 includes a concave curved sliding contact surface 171 formed to have a generally sideway U-shaped cross section so as to conform to the outer circumferential surface of the cylindrical platen roller 16. A pressing coil spring 20 is provided between the paper guide 17 and the main body case 2. The pressing coil spring 20 biases the sliding contact surface 171 towards the outer circumferential surface of the platen roller 16.

In the printing apparatus 1 with the above structure, a sheet of paper 7 that has been separated at the above-described sheet separation part 11 is transferred by the pickup roller 12, and passed through between the lower end of the separation block 13 and a guide plate 21 provided for directing the paper toward the platen roller 16. The sheet 7 is guided by the guide plate 21 and fed from the underside of the platen roller 16 to between the platen roller 16 and the paper guide 17. The sheet 7 is further transferred as it is inverted in a sideway U shape by the rotation of the platen roller 16 between the outer circumferential surface of the platen roller 16 and the sliding contact surface 171 of the paper guide 17, until it reaches the upper side of the platen roller 16 with its printing surface facing outwards.

As shown in FIG. 4, the thermal head 15 positioned on the upper side of the platen roller 16 includes a heat generator 151, which is a printing portion. The thermal head 15 is provided such as to be rotatable around a rotary shaft 152, so that the heat generator 151 can be contacted to and separated from the upper surface of the platen roller 16. The reason why the thermal head 15 is configured rotatable is to prevent the thermal head 15 from being an obstacle to a paper removal operation in the event that a sheet 7 is stuck between the platen roller 16 and the paper guide 17.

As shown in FIG. 4, one end of a spring 22 which is a torsion coil spring engages with the thermal head 15 so that a biasing force is constantly applied in a direction in which the heat generator 151 of the thermal head 15 approaches the upper surface of the platen roller 16. With this structure, the heat generator 151 of the thermal head 15 makes contact with the printing surface of a sheet 7 transferred by the platen roller 16 with its printing surface facing upwards as mentioned above, and printing is achieved on the sheet 7 at a location where the heat generator 151 makes contact.

The thermal head 15 is of a line head type, which can print desired characters or images on thermal sheets 7 transferred thereto line by line along a direction orthogonal to the transfer direction of the sheets 7. A printing width for the printing of each line is set substantially equal to the width of the sheet 7 that is the printing object. The thermal head 15 is used as the printing head because, by using thermal paper as recording media, consumable supplies such as inks or ink ribbons are made unnecessary, and further, a mechanism or the like for supplying inks can be omitted so that the printing apparatus 1 can be configured compactly. For the thermal paper, a heat-sensitive color-developing type having a color-developing layer that develops color upon heating by the thermal head 15, or a heat-sensitive punch type having a punch layer that is punched by the heating laminated on a base layer, and various other types can be used.

The separation block 13 is formed with a paper discharge guide surface 132 inclined relative to the paper feed-out direction of the platen roller 16. With this structure, the sheet 7 after it has been printed by the heat generator 151 of the thermal head 15 is guided by the paper discharge guide surface 132. The sheet 7 is then discharged onto the upper side of the cover portion 10 through a slit formed between the upper cover 5 of the main body case 2 and cover portion 10, as shown in FIG. 1. As shown in FIGS. 3 and 4, the printing apparatus 1 is provided with a reflective optical sensor 80 at a position opposite a second cut-out portion 53 to be described later. The reflective optical sensor 80 consists of a set of a light-emitting element (for example a light-emitting diode) and a light-receiving element (for example a photo transistor), so that it emits light and receives a reflected light thereof to detect presence or absence of sheets 7. Paper is generally white and reflects much light. On the other hand, the backside of the cover portion 10 is painted with a color that reflects little light (for example black). Therefore, when there are sheets 7 in the sheet package 9, the amount of reflected light is large because the light emitted from the reflective optical sensor 80 is reflected by the sheets 7. On the other hand, where there are no sheets 7 in the sheet package 9, the amount of reflected light is small because the light emitted from the reflective optical sensor 80 is reflected by the backside of the cover portion 10. The reflective optical sensor 80 detects this amount of reflected light.

The sheet package 9 that is the first embodiment of the present disclosure and set in the printing apparatus 1 will be described in detail with reference to FIGS. 5 to 18.

Figure 5:
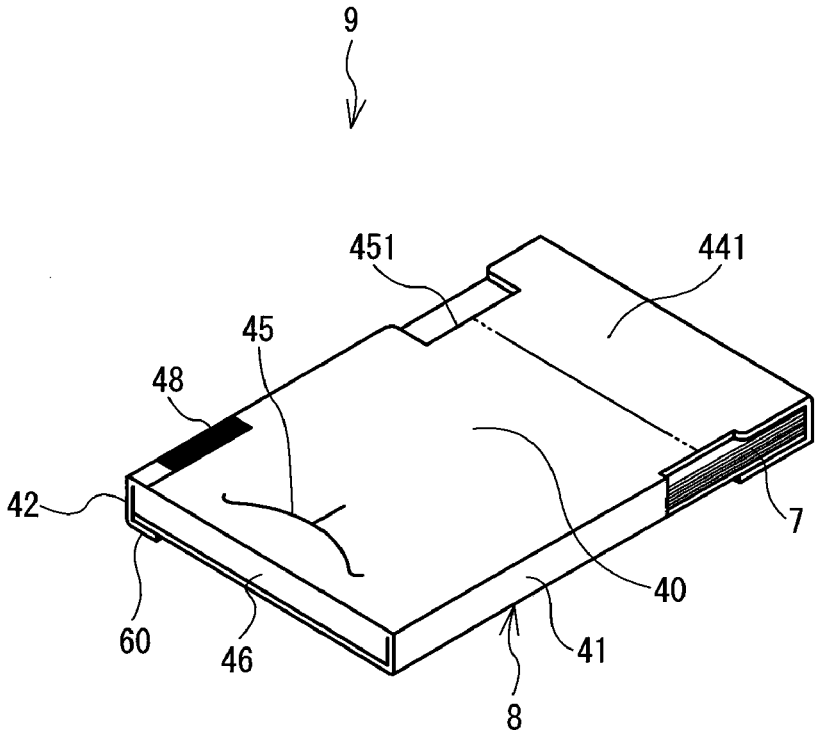
FIG. 5 is a perspective view of the sheet package.
Figure 6:
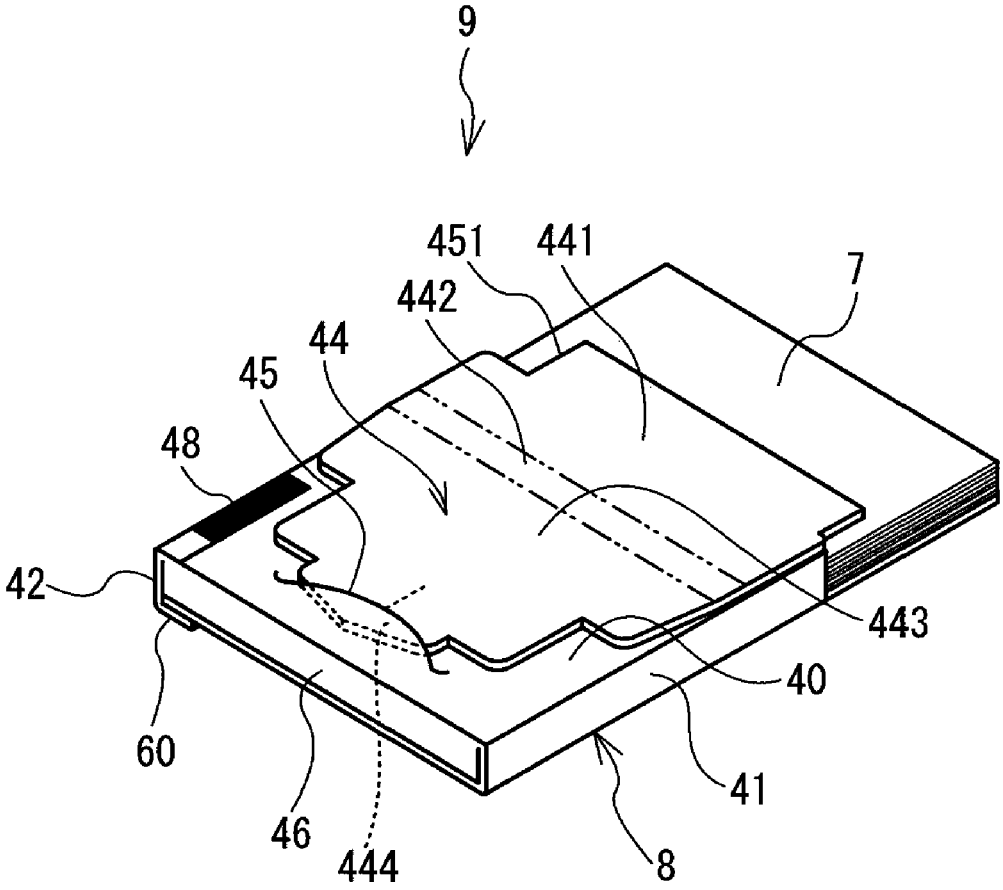
FIG. 6 is a perspective view of the sheet package in a state in which a lid part is folded back to the backside.
Figure 7:
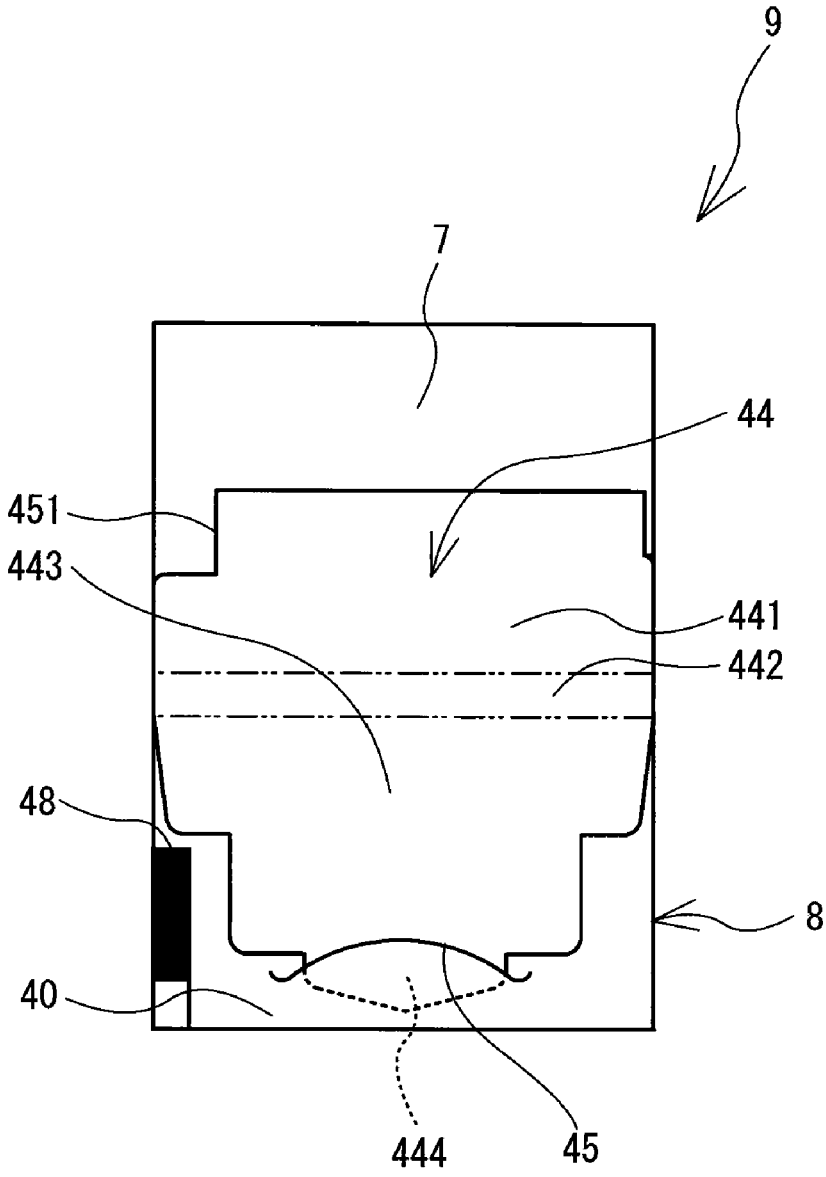
FIG. 7 is a bottom view of the sheet package.

As shown in FIG. 5, the sheet package 9 is formed in a thin box-like parallelepiped shape obtained by folding the plate-like package member 8. Multiple sheets of paper (recording media) 7 are stacked and accommodated in the sheet package 9. The sheets 7 are cut sheets of thermal paper in a small size of, for example, A6 or A7. The user purchases the sheet package 9 sold in a boxed state shown in FIG. 5. Next, as shown in FIGS. 6 and 7, the user opens a lid part 44 of the sheet package 9 and folds it back to the backside to expose the sheets 7 in the sheet package 9, and inserts an insertion portion 444 of the lid part 44 into a third slit 45 in the first flat surface portion 40 to retain the lid part 44. The user then sets the sheet package 9 with this state into the paper containing portion 6 of the printing apparatus 1 for use. In the following description, when the sheet package 9 is set into the paper containing portion 6, one end of the sheet package 9 disposed on the side of the printing mechanism 14 will be referred to as a front end, while the other end on the opposite side will be referred to as a rear end, and two other opposing ends will be referred to as side edges. A direction along a line connecting the front end and rear end of the sheet package 9 will be referred to as a front to back direction, while a direction along a line connecting both side edges orthogonal to the front to back direction will be referred to as a left to right direction. The same applies to the front end, rear end, and side edges of the sheets 7.

Figure 8:
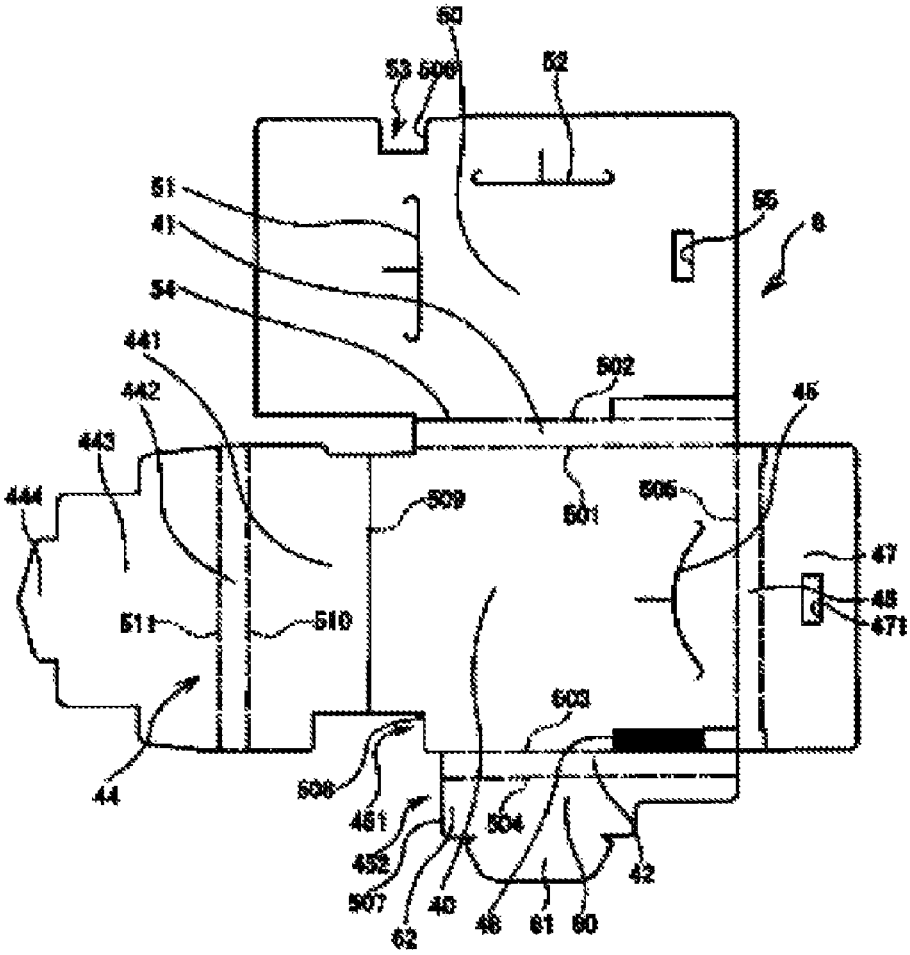
FIG. 8 is a development view from the outer side of a package member.
Figure 9:
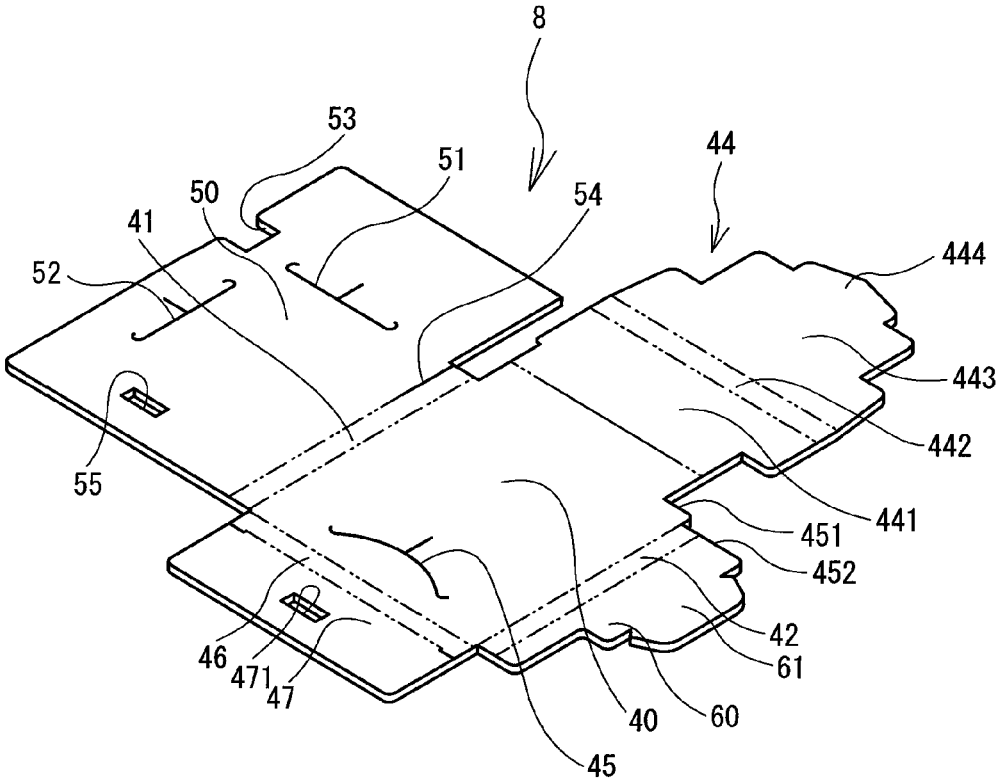
FIG. 9 is a perspective view from the inner side of the package member in the developed state.

The structure of the package member 8 will be described with reference to FIGS. 8 and 9. As shown in FIGS. 8 and 9, the package member 8 is formed by punching out a planar thick paper material. The substantially rectangular first flat surface portion 40 is provided in a central portion of the package member 8. The substantially rectangular first flat surface portion 40 is a bottom part covering a surface on one side in the stacking direction of stacked sheets 7.

A rectangular first side face portion 41 extends from one side edge 501 of the pair of side edges of the first flat surface portion 40, and a rectangular second side face portion 42 extends from the other side edge 503. The first side face portion 41, second side face portion 42, and a third side face portion 46 to be described later have the same height (width in a short-side direction), which is larger than the height of stacked sheets 7 accommodated inside the sheet package 9. The first side face portion 41 and second side face portion 42 respectively cover both sides of the stacked sheets 7. The third side face portion 46 covers a side face at the rear end of the stacked sheets 7.

As shown in FIGS. 8 and 9, the lid part 44 extends from the front end 509 of the first flat surface portion 40. The lid part 44 includes a lid base 441, a lid side face portion 442, a lid distal end 443, and the insertion portion 444. The rectangular lid side face portion 442 extends from an end 510 of the lid base 441. The lid side face portion 442 has the same height (width in a short-side direction) as that of the first side face portion 41 and second side face portion 42. The lid distal end 443 extends from an end 511 of the lid side face portion 442 and has a smaller width in the left to right direction than that of the lid side face portion 442. The insertion portion 444 extending from the lid distal end 443 has a smaller width in the left to right direction than that of the lid distal end 443, and includes a pair of inclined sides at the tip. The first flat surface portion 40 and lid base 441 combined substantially conform to the stacked sheets of paper 7.

The outer surface of the insertion portion 444 is printed in black or with a black checkered pattern, although not shown. With the outer surface of the insertion portion 444 being colored in a different color from the color of the sheets 7, when the color of the sheets 7 is visible from an opening 55 to be described later, it means there are sheets 7 inside the sheet package 9. When the color of the outer surface of the insertion portion 444 is visible from the opening 55, it means there are no sheets 7 inside the sheet package 9. The outer surface of the insertion portion 444 may be of the same color as that of a printed portion on the outer side of the package member 8, so that the number of printing colors need not be increased. The color of the outer surface of the insertion portion 444 is not limited to black but may be red or other colors.

The rectangular third side face portion 46 extends from the rear end 505 of the first flat surface portion 40. The third side face portion 46 includes a rectangular tongue portion 47 for receiving the upper face at the rear end of the stack of sheets 7 when the sheet package 9 is assembled. An opening 471, which is a rectangular hole, is formed in a central portion of the tongue portion 47.

As shown in FIGS. 8 and 9, a rectangular second flat surface portion 50 is foldably extended from an end 502 of the first side face portion 41 of the first flat surface portion 40, for covering the sheets 7 opposite the first flat surface portion 40 after the assembly. In FIGS. 8 and 9, the two dotted chain lines indicate the portions processed to have folding lines, whereby the thick paper material is easily folded at these folding lines for the convenience of assembly.

A first slit 51 and a second slit 52 are formed in the second flat surface portion 50. The first slit 51 is a cut in which the insertion portion 444 of the lid part 44 is inserted. The second slit 52 is a cut in which an insertion portion 61 of the third flat surface portion 60 to be described later is inserted. A second cut-out portion 53 which is a rectangular notch is provided in a side edge of the second flat surface portion 50 opposite the lid base 441. In the printing apparatus 1, the light from the reflective optical sensor 80 is emitted toward the second cut-out portion 53, and presence or absence of sheets 7 is detected based on the amount of reflected light (see FIGS. 3 and 4). Specific procedures will be described below. The sheet package 9 is accommodated in the paper containing portion 6 of the printing apparatus 1 in a state shown in FIGS. 6 and 7. The printing apparatus 1 includes the reflective optical sensor 80 (see FIGS. 3 and 4) at a position opposite the second cut-out portion 53. The reflective optical sensor 80 is provided on the side of the first flat surface portion 40 in close proximity thereto. The reflective optical sensor 80 emits light from the side of the first flat surface portion 40 through a first cut-out portion 451 to be described later toward the second cut-out portion 53. When there are sheets 7 in the sheet package 9, the reflective optical sensor 80 detects light reflected by the sheets 7. When there are no sheets 7 in the sheet package 9, the reflective optical sensor 80 detects light reflected by synthetic resin forming the pressing plate 18 of the cover portion 10. Therefore, by making the color of the synthetic resin forming the pressing plate 18 of the cover portion 10 to have low reflectivity, presence or absence of paper is detected easily based on the detected amount of reflected light.

As shown in FIG. 8, a sensor mark 48 that indicates a type and a size of the sheets 7 accommodated in the sheet package 9 is printed at a side edge of the first flat surface portion 40 on the front side (outer side) of the package member 8. The sensor mark 48 is read by a reflection type optical sensor (different from the reflective optical sensor 80 and not shown) provided in the printing apparatus 1.

As shown in FIGS. 8 and 9, a third slit 45, in which the insertion portion 444 of the folded-back lid part 44 is inserted, is provided in the first flat surface portion 40. Both ends of the third slit 45 are cut in a curve toward the lid part 44. In the middle of the third slit 45 is formed a straight cut of a predetermined length toward the lid part 44. The first slit 51, second slit 52, and third slit 45 are formed simultaneously with the punching process of the package member 8.

An opening 55 is provided at the rear end of the second flat surface portion 50. The opening 55 is used for checking presence or absence of sheets 7 accommodated in the sheet package 9. The shape of the opening 55 is not limited to particular ones. Here, as one example, it is shown as being rectangular. The opening 55 is provided at a position in the second flat surface portion 50 that will face the insertion portion 444 inserted through the third slit 45 when the sheet package 9 is assembled. Therefore, the opening 55 is provided in the second flat surface portion 50 at a position somewhat more toward the rear end than the position facing the third slit 45. The opening 55 is also formed simultaneously with the punching process of the package member 8 similarly to the first slit 51, second slit 52, and third slit 45.

Between the first side face portion 41 and second flat surface portion 50 is provided a cut portion 54 in a predetermined length. This cut portion 54 allows the second flat surface portion 50 to deflect easily when the sheet package 9 is accommodated in the paper containing portion 6 and the second flat surface portion 50 is pressed by the pressing plate 18.

As shown in FIGS. 8 and 9, from an end 504 of the second side face portion 42 extending from a side edge of the first flat surface portion 40 is extended a third flat surface portion 60 for retaining the second flat surface portion 50 that covers the sheets 7 opposite the first flat surface portion 40 after the assembly. The width in the left to right direction of the third flat surface portion 60 is smaller than the width in the left to right direction of the second flat surface portion 50. The insertion portion 61 is formed on a side edge of the third flat surface portion 60. When the sheet package 9 is assembled, the insertion portion 61 is inserted into the second slit 52 of the second flat surface portion 50 to retain the second flat surface portion 50.

As shown in FIGS. 8 and 9, a first cut-out portion 451 is formed in a connecting portion between the first flat surface portion 40 and lid base 441 on the side of the third flat surface portion 60. The first cut-out portion 451 is rectangular and twice larger in area than the second cut-out portion 53. The first cut-out portion 451 is formed at a position where it will face the second cut-out portion 53 when the sheet package 9 is assembled. When the lid base 441 is folded back to the side of the first flat surface portion 40, the area of the first cut-out portion 451 becomes substantially the same as the area of the second cut-out portion 53. The light from the reflective optical sensor 80 passes through the second cut-out portion 53 and the first cut-out portion 451 to detect presence or absence of sheets 7. In the transfer direction of the sheets 7, the rear end of the second cut-out portion 53 is disposed for a predetermined distance from the rear end of the first cut-out portion 451 toward the rear end of the sheet package 9.

A third cut-out portion 452 is formed at the front end (on the side of the transfer direction of sheets) of the third flat surface portion 60. The third cut-out portion 452 is formed by cutting out a front end portion of the third flat surface portion 60 a predetermined distance toward the rear end of the sheet package 9 from the rear end 508 of the first cut-out portion 451. The provision of the third cut-out portion 452 prevents light from the reflective optical sensor 80 from being reflected by the backside of the third flat surface portion 60 and thereby prevents erroneous detection of presence of sheets 7 even though there are no sheets 7 inside the sheet package 9.

Figure 18:
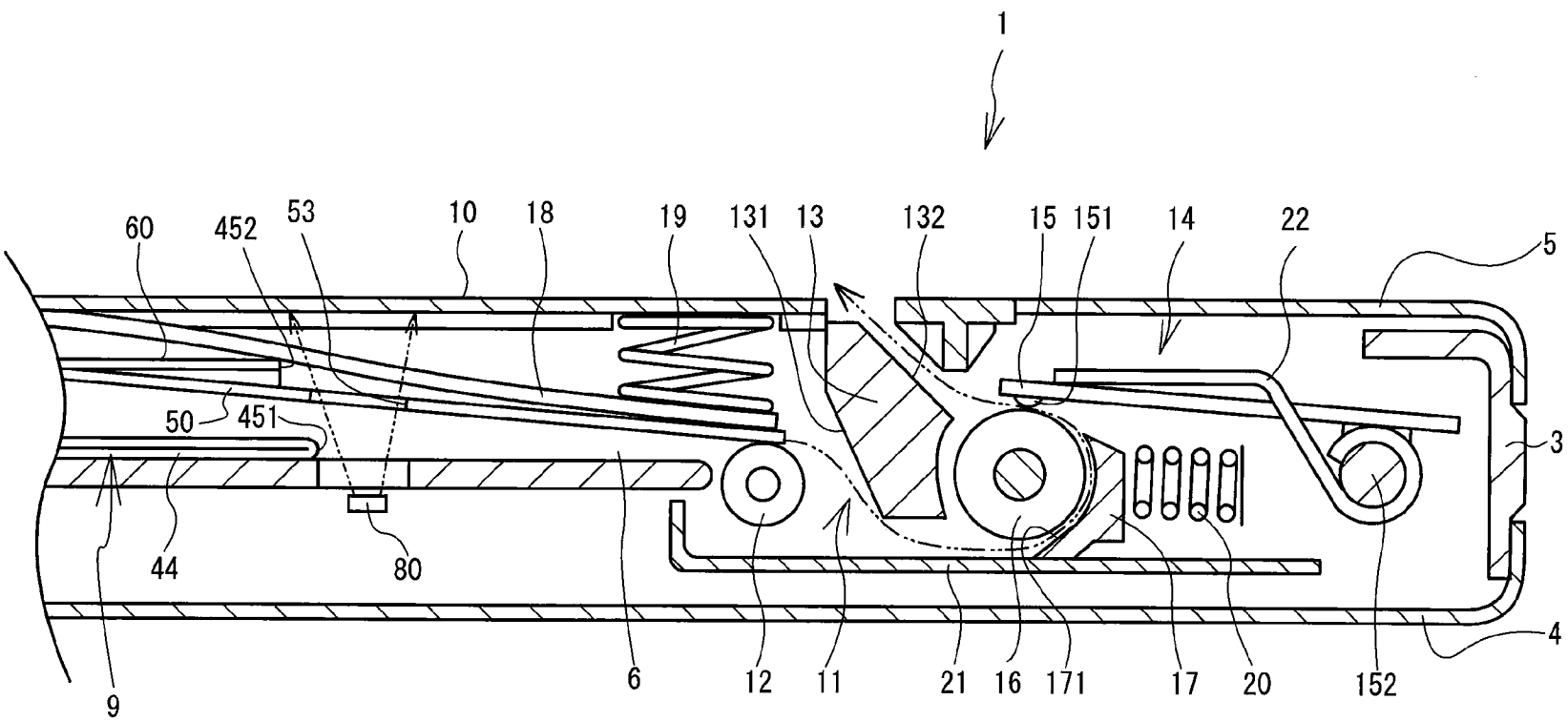
FIG. 18 is a cross-sectional view taken along the line I-I in FIG. 1 of the printing apparatus in a state in which there are no sheets inside the sheet package, viewed from the direction of arrows.

The third cut-out portion 452 may be formed by cutting out a front end portion of the third flat surface portion 60 a predetermined distance toward the rear end of the sheet package 9 from the rear end 506 of the second cut-out portion 53. Namely, the first cut-out portion 451, second cut-out portion 53, and third cut-out portion 452 may be arranged such that their respective rear ends are positioned in the order of the rear end 508 of the first cut-out portion 451, the rear end 506 of the second cut-out portion 53, the rear end 507 of the third cut-out portion 452 toward the rear end of the sheet package 9. Light from the reflective optical sensor 80 is diffused as shown in FIG. 18. Thus, with the configuration described above, since the cut-out portions formed in the surfaces portions are wider as the distanced from the reflective optical sensor 80, even though the light from the reflective optical sensor 80 is diffused, the reflection of the light by respective surfaces portions is prevented more accurately.

Figure 10:
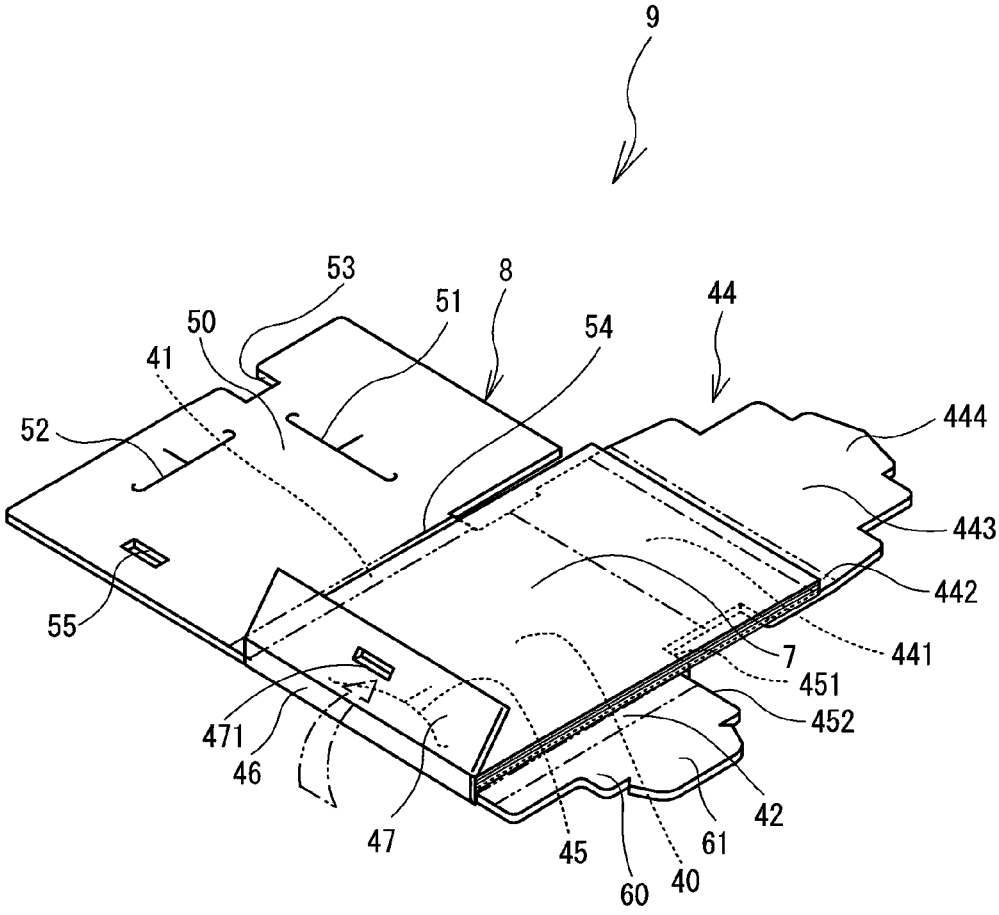
FIG. 10 is a perspective view showing a process of producing the sheet package.

The process of producing the sheet package 9 will be described below with reference to FIGS. 10 to 13. First, as shown in FIG. 10, sheets 7 are stacked upon the first flat surface portion 40. If the sheets 7 are thermal paper, they are stacked such that the heat-sensitive surface is oriented toward the first flat surface portion 40. Therefore, the upper surface of the stacked sheets 7 is the backside surface of the heat-sensitive surface.

Figure 11:
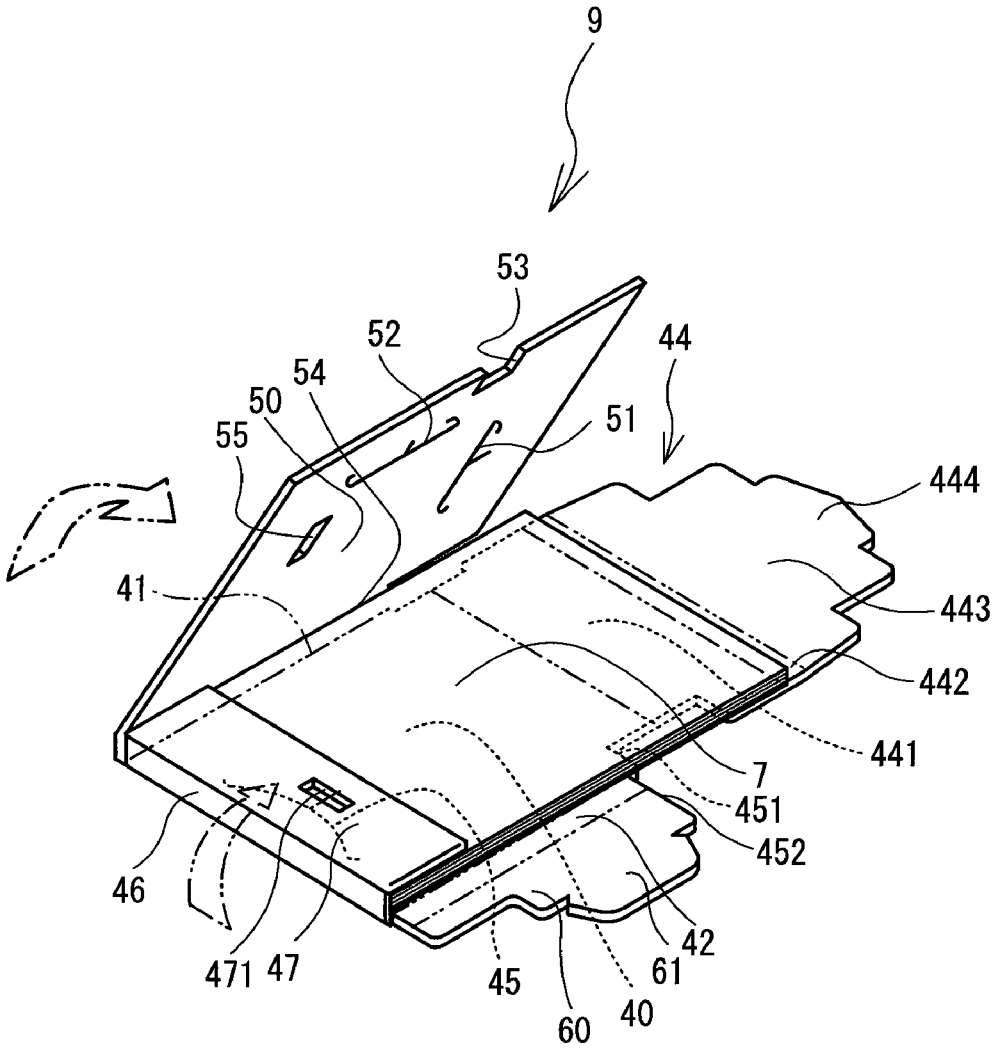
FIG. 11 is a perspective view showing a process of producing the sheet package.

Next, the third side face portion 46 of the package member 8 is folded upwards. Then, as shown in FIG. 11, the tongue portion 47 is folded over onto the sheets 7. Next, as shown in FIG. 11, the first side face portion 41 is folded upwards, and further the second flat surface portion 50 is folded over onto the sheets 7.

Figure 12:
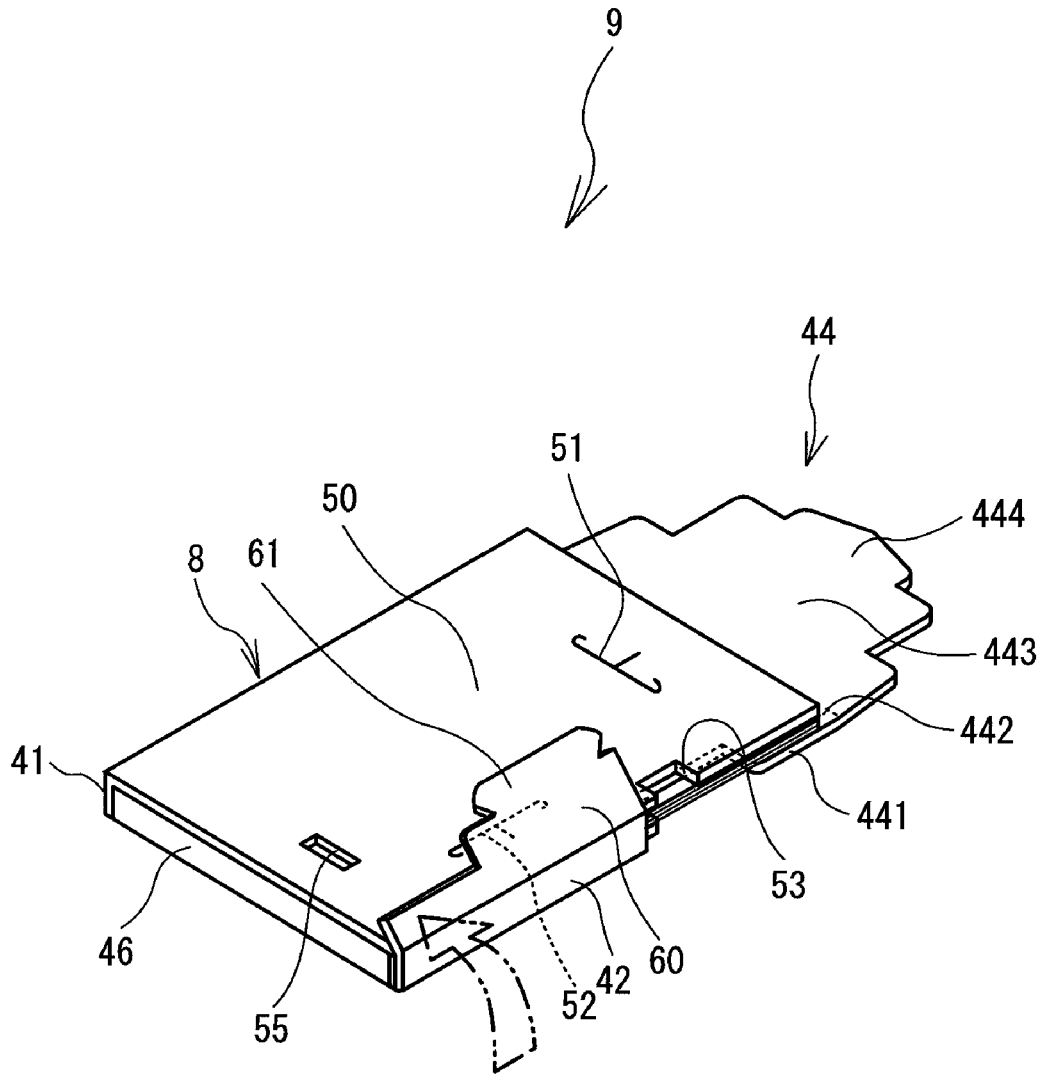
FIG. 12 is a perspective view showing a process of producing the sheet package.

Next, as shown in FIG. 12, the second side face portion 42 is folded upwards perpendicularly, after which the third flat surface portion 60 is folded over onto the outer side of the second flat surface portion 50. Then, as shown in FIG. 13, the insertion portion 61 of the third flat surface portion 60 is inserted into the second slit 52 of the second flat surface portion 50.

Figure 13:
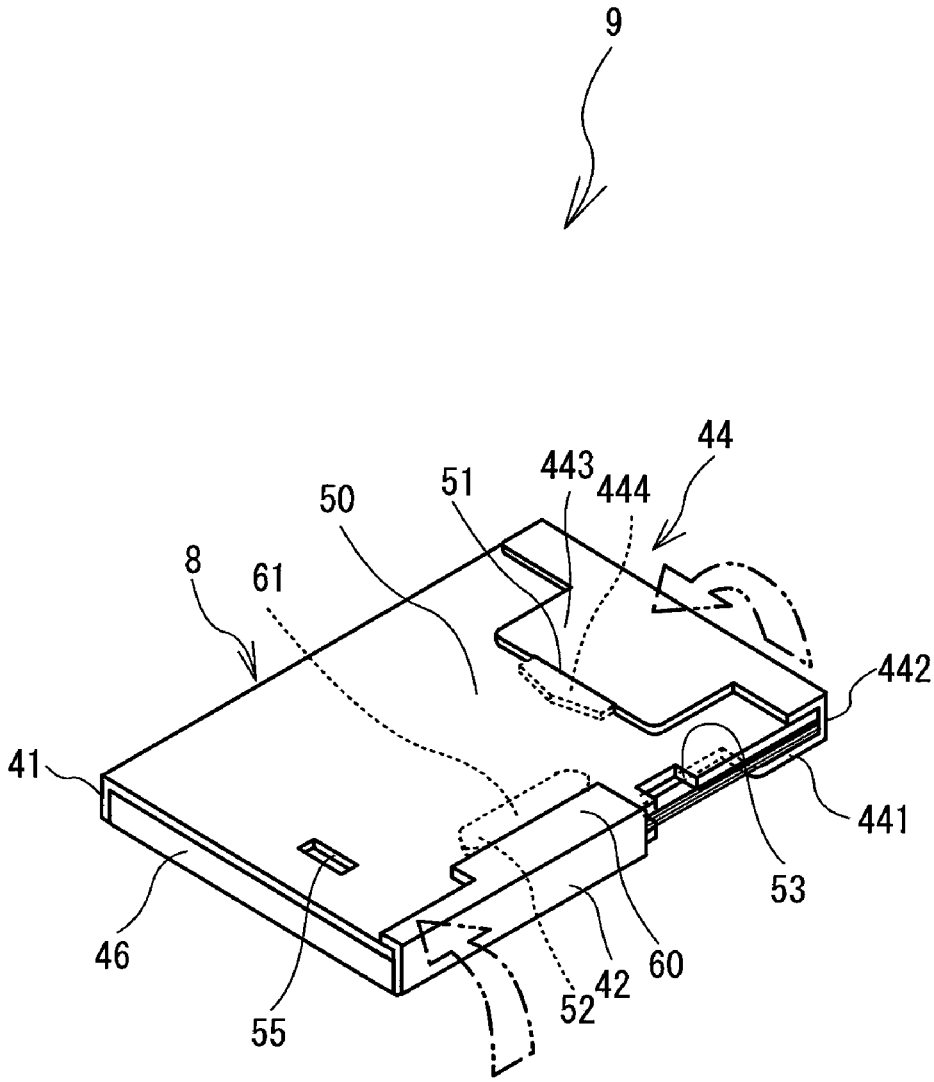
FIG. 13 is a perspective view showing a process of producing the sheet package.

Lastly, as shown in FIG. 13, the lid part 44 is similarly folded over onto the outer side of the second flat surface portion 50, and with the insertion portion 444 of the lid part 44 being inserted into the first slit 51 of the second flat surface portion 50, the sheet package 9 is finished. The sheet package 9 is sold in this state.

Figure 14:
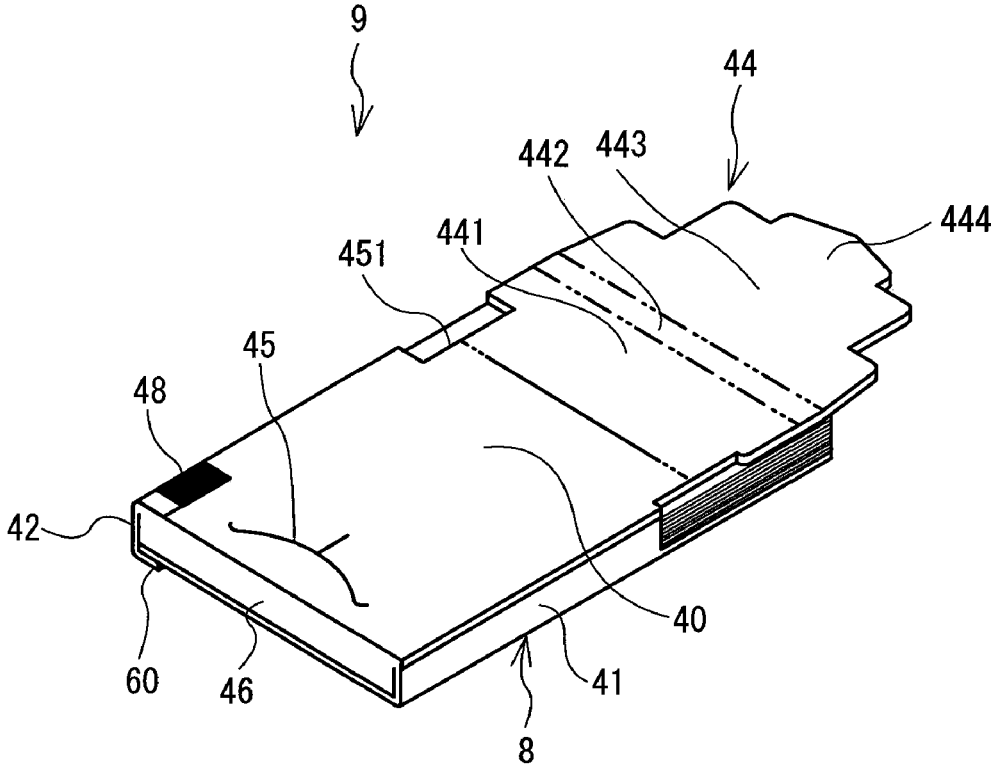
FIG. 14 is a perspective view showing how the sheet package is opened for use.
Figure 15:
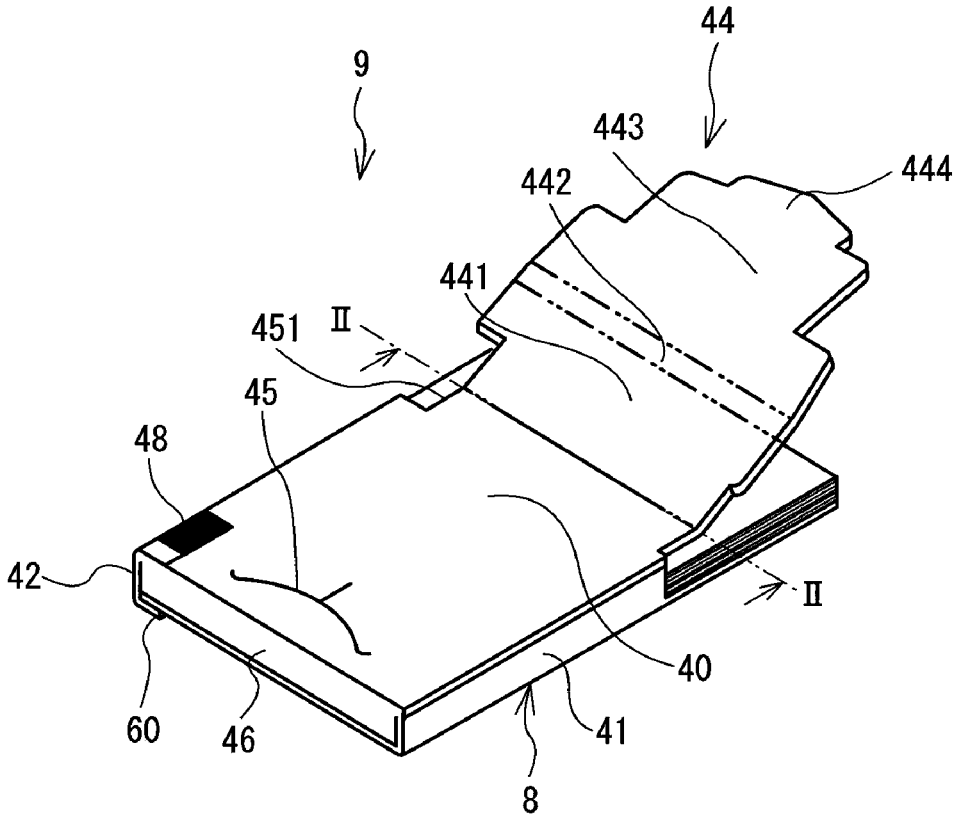
FIG. 15 is a perspective view showing how the sheet package is opened for use.

How the sheet package 9 is used will be described with reference to FIGS. 6, 7, 13 to 17. The sheet package 9 is in a state shown in FIG. 13 when used. First, as shown in FIG. 14, the lid part 44 of the sheet package 9 is lifted, and then, as shown in FIG. 15, the lid part 44 is folded back to the backside at the line II-II. Next, as shown in FIGS. 6 and 7, the insertion portion 444 of the lid distal end 443 of the lid part 44 is inserted into the third slit 45 of the first flat surface portion 40 to retain the lid part 44 to the first flat surface portion 40.

Figure 16:
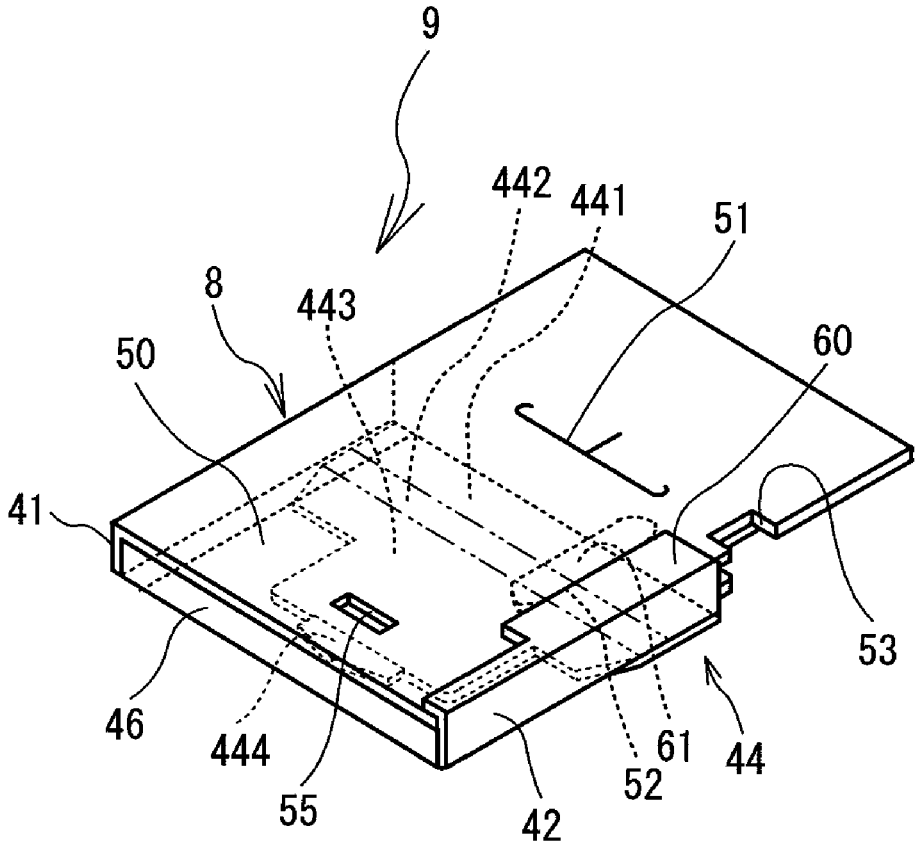
FIG. 16 is a perspective view of the sheet package in which an insertion portion of the lid part is inserted into a third slit in a first flat surface portion and in which no sheets are present.

The outer surface of the insertion portion 444 is colored in black or printed with a black checkered pattern. Therefore, with the insertion portion 444 being inserted in the third slit 45 of the first flat surface portion 40, the outer surface of the insertion portion 444 is exposed on the inner face of the first flat surface portion 40 inside the sheet package 9 as shown in FIG. 16.

Figure 17:
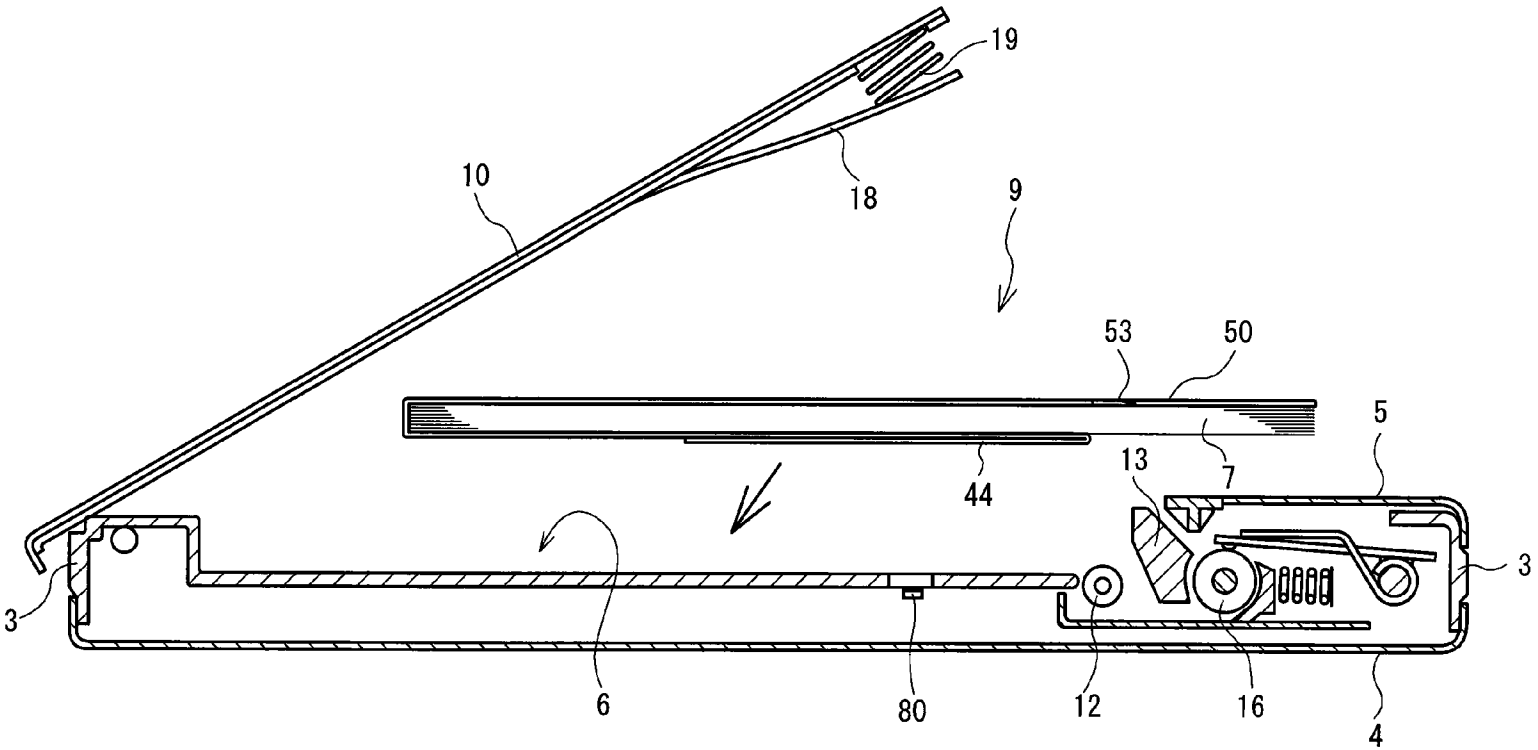
FIG. 17 is a cross-sectional view showing how the sheet package is placed into the printing apparatus.

In the state described above, the sheet package 9 is accommodated in the paper containing portion 6 of the printing apparatus 1 as shown in FIG. 17. When the cover portion 10 is closed, the pressing plate 18 presses the second flat surface portion 50 of the sheet package 9, so that the lowermost one of stacked sheets 7 is pressed against the pickup roller 12.

Figure 19:
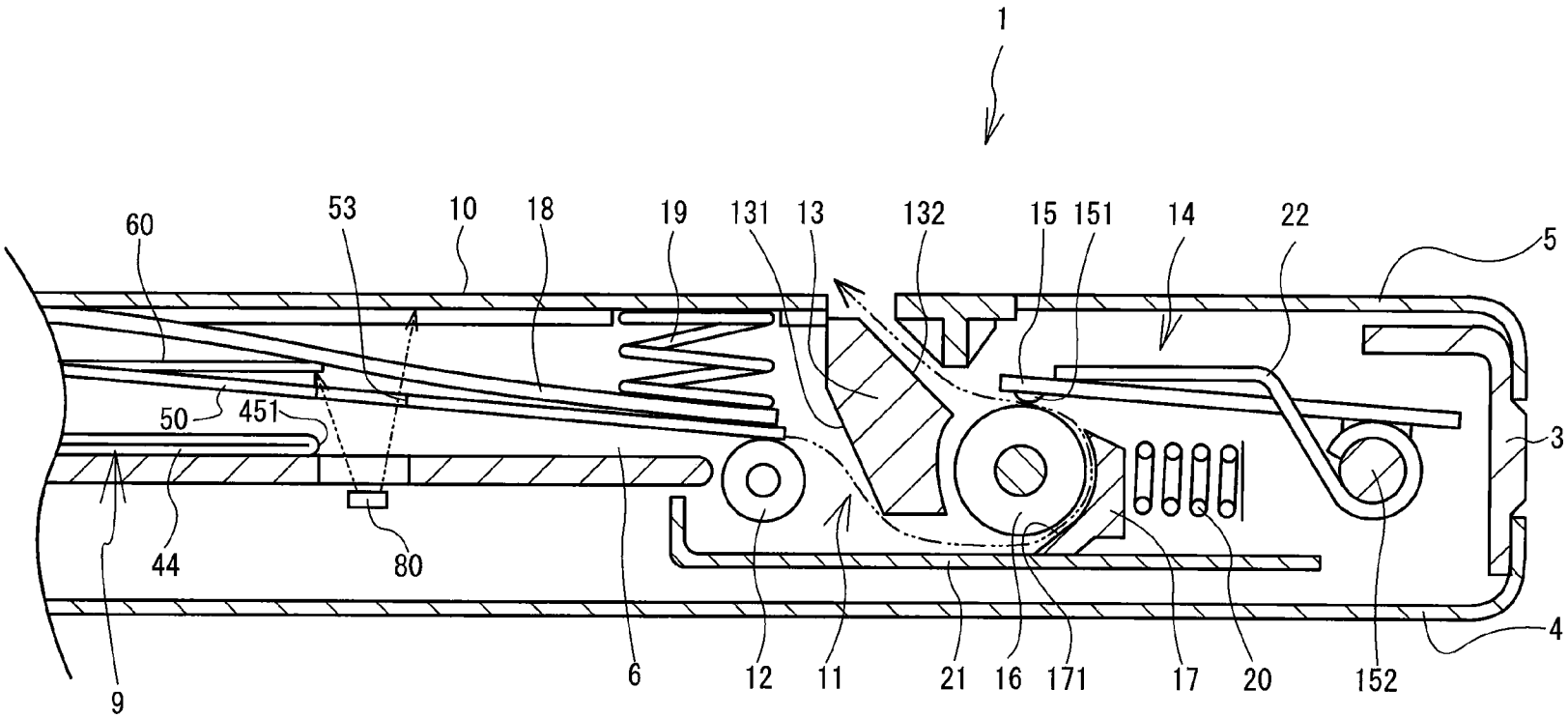
FIG. 19 RELATED ART
FIG. 19 is a cross-sectional view taken along the line I-I in FIG. 1 of the printing apparatus in a state in which there are no sheets inside a conventional sheet package, viewed from the direction of arrows.

At this time, the reflective optical sensor 80 provided in the printing apparatus 1 faces the second cut-out portion 53 provided in the second flat surface portion 50 of the sheet package 9 (see FIGS. 3 and 4). Therefore, as shown in FIG. 4, when there are sheets 7 inside the sheet package 9, the reflective optical sensor 80 detects reflected light reflected by the sheets 7. As shown in FIG. 18, when there are no sheets 7 inside the sheet package 9, the reflective optical sensor 80 detects reflection light reflected by the pressing plate 18 of the cover portion 10. As shown in FIG. 18, since the third cut-out portion 452 is formed in the third flat surface portion 60 of the sheet package 9, it is prevented that paper is erroneously detected to be present even though there are no sheets 7 inside the sheet package 9, which is caused by the reflective optical sensor 80 receiving light reflected by the backside of the third flat surface portion 60. On the other hand, with the conventional sheet package 9 shown in FIG. 19, since the third flat surface portion 60 is not formed with the third cut-out portion 452, the reflective optical sensor 80 receives light reflected by the backside at a front end portion of the third flat surface portion 60 and detects paper erroneously as if it were present even though there are no sheets 7.

The present disclosure is not limited to the above-described embodiment and various modifications are possible. For example, the sheet package 9 is not limited to the above-described shape, and its left and right shapes may be formed inversely.

While the sheet package in the above-described embodiment includes the second side face portion 42 and third side face portion 46, these may be omitted. In this case, the rear end of the second cut-out portion 53 formed in the second flat surface portion 50 is disposed more toward the rear end of the sheet package than the end of the first cut-out portion 451 on the rear end side of the sheet package, so that, when there are no sheets, it is prevented that paper is erroneously detected to be present, which is caused by light from the reflective optical sensor 80 being reflected by the backside of the second flat surface portion 50.

What is claimed is:

1. A sheet package to be accommodated in a printing apparatus for supplying sheets as print media to the printing apparatus, comprising:

stacked sheets; and a package member that includes, at least a rectangular first flat surface portion, covering at least part of a surface on one side in a stacking direction of the stacked sheets, a rectangular first side face portion foldably extended from an end portion of the first flat surface portion, and covering a side face of the stacked sheets, a rectangular second flat surface portion foldably extended from an end portion of the first side face portion on an opposite side of the end portion of the first side face portion connecting to the first flat surface portion such as to face the first flat surface portion and covering another surface on the opposite side of the surface on one side in the stacking direction of the stacked sheets, a rectangular second side face portion foldably extended from an end portion of the first flat surface portion on an opposite side of the end portion of the first flat surface portion connecting to the first side face portion and covering a side face of the stacked sheets, a third flat surface portion foldably extended from an end portion of the second side face portion on an opposite side of the end portion of the second side face portion connecting to the first flat surface portion and formed with an insertion portion to be inserted into a cut portion provided in the second flat surface portion, a rectangular third side face portion foldably extended from an end portion of the first flat surface portion on an opposite side of a direction in which sheets are transferred to the printing apparatus and covering an end face on the opposite side of the transfer direction of the stacked sheets, a first cut-out portion formed in the first flat surface portion at the end portion of the first flat surface portion connecting to the second side face portion, through which light from an optical sensor disposed opposite the first flat surface portion is passed for detecting presence or absence of the sheets, a second cut-out portion formed in the second flat surface portion at a position opposite the first cut-out portion, through which the light from the optical sensor is passed; and a third cut-out portion formed in an end portion on a side of the transfer direction of sheets of the third flat surface portion, wherein an end portion of the third cut-out portion is disposed more toward the opposite side of the transfer direction of sheets than the second cut-out portion, and an end portion on the opposite side of the transfer direction of sheets of the second cut-out portion is disposed more toward the opposite side of the transfer direction of sheets than an end portion on the opposite side of the transfer direction of sheets of the first cut-out portion.

2. The sheet package according to claim 1, the package member further comprising:

a lid base foldably extended from an end portion of the first flat surface portion on an opposite side of the end portion of the first flat surface portion connecting to the third side face portion and covering at least part of the surface on one side in the stacking direction of the stacked sheets;

a rectangular lid side face portion foldably extended from an end portion of the lid base on an opposite side of the end portion of the lid base connecting to the first flat surface portion and covering an end face on a transfer direction side of said stacked sheets; and a lid distal end foldably extended from an end portion of the lid side face portion on an opposite side of the end portion of the lid side face portion connecting to the lid base.

3. The sheet package according to claim 1, the package member further comprising:

a cut portion provided between the first side face portion and the second flat surface portion in a predetermined length.

4. A sheet package to be accommodated in a printing apparatus for supplying sheets as print media to the printing apparatus, comprising;

stacked sheets; and a package member that includes, at least a rectangular first flat surface portion covering at least part of a surface on one side in a stacking direction of the stacked sheets, a rectangular first side face portion foldably extended from an end portion of the first flat surface portion, and covering a side face of the stacked sheets, a rectangular second flat surface portion foldably extended from an end portion of the first side face portion on an opposite side of the end portion of the first side face portion connecting to the first flat surface portion such as to face the first flat surface portion and covering another surface on the opposite side of the surface on one side in the stacking direction of the stacked sheets, a rectangular second side face portion foldably extended from an end portion of the first flat surface portion on an opposite side of the end portion of the first flat surface portion connecting to the first side face portion and covering a side face of the stacked sheets, a third flat surface portion foldably extended from an end portion of the second side face portion on an opposite side of the end portion of the second side face portion connecting to the first flat surface portion and overlying the second flat face portion and formed with an insertion portion to be inserted into a cut portion provided in the second flat surface portion, a rectangular third side face portion foldably extended from an end portion of the first flat surface portion on an opposite side of a direction in which sheets are transferred to the printing apparatus and covering an end face on the opposite side of the transfer direction of the stacked sheets, a first cut-out portion formed in the first flat surface portion at the end portion of the first flat surface portion connecting to the second side face portion, through which light from an optical sensor disposed opposite the first flat surface portion is passed for detecting presence or absence of the sheets, a second cut-out portion formed in the second flat surface portion at a position opposite the first cut-out portion, through which the light from the optical sensor is passed;

a third cut-out portion formed in an end portion on a side of the transfer direction of sheets of the third flat surface portion; and the end portion on the opposite side of the transfer direction of sheets of the third cut-out portion is disposed more toward the opposite side of the transfer direction of sheets than the end portion on the opposite side of the transfer direction of sheets of the second cut-out portion, and the end portion on the opposite side of the transfer direction of sheets of the second cutout portion is disposed more toward the opposite side of the transfer direction of sheets than the end portion on the opposite side of the transfer direction of sheets of the first cut-out portion;

wherein an end portion of the third cut-out portion is disposed more toward the opposite side of the transfer direction of sheets than an end portion on the opposite side of the transfer direction of sheets of first cut-out portion.

5. The sheet package according to claim 4, the package member further comprising:

a lid base foldably extended from an end portion of the first flat surface portion on an opposite side of the end portion of the first flat surface portion connecting to the third side face portion, and covering at least part of the surface on one side in the stacking direction of the stacked sheets;

a rectangular lid side face portion foldably extended from end portion of the lid base on an opposite side of the end portion of the lid base connecting to the first flat surface portion and covering an end face on a transfer direction side of said stacked sheets; and a lid distal end foldably extended from an end portion of the lid side face portion on an opposite side of the end portion of the lid side face portion connecting to the lid base.

6. The sheet package according to claim 4, the package member further comprising:

a cut portion provided between the first side face portion and the second flat surface portion in a predetermined length.

7. A sheet package to be accommodated in a printing apparatus for supplying sheets as print media to the printing apparatus, comprising:

stacked sheets; and a package member that includes, at least a rectangular first flat surface portion covering at least part of a surface on one side in a stacking direction of the stacked sheets, a rectangular first side face portion foldably extended from an end portion of the first flat surface portion, and covering a side face of the stacked sheets, a rectangular second flat surface portion foldably extended from an end portion of the first side face portion on an opposite side of the end portion of the first side face portion connecting to the first flat surface portion such as to face the first flat surface portion and covering another surface on the opposite side of the surface on one side in the stacking direction of the stacked sheets, a rectangular second side face portion foldably extended from an end portion of the first flat surface portion on an opposite side of the end portion of the first flat surface portion connecting to the first side face portion and covering a side face of the stacked sheets, a third flat surface portion foldably extended from an end portion of the second side face portion on an opposite side of the end portion of the second side face portion connecting to the first flat surface portion and formed with an insertion portion to be inserted into a cut portion provided in the second flat surface portion, a rectangular third side face portion foldably extended from an end portion of the first flat surface portion on an opposite side of a direction in which sheets are transferred to the printing apparatus and covering an end face on the opposite side of the transfer direction of the stacked sheets, a first cut-out portion formed in the first flat surface portion at the end portion of the first flat surface portion connecting to the second side face portion, through which light from an optical sensor disposed opposite the first flat surface portion is passed for detecting presence or absence of the sheets, a second cut-out portion formed in the second flat surface portion at a position opposite the first cut-out portion, through which the light from the optical sensor is passed;

the end portion on a forward side of the transfer direction of sheets of the third flat surface portion is disposed toward the opposite side of the transfer direction of sheets than the end portion on the opposite side of the transfer direction of sheets of the second cut-out portion, and the end portion on the opposite side of the transfer direction of sheets of the second cutout portion is disposed more toward the opposite side of the transfer direction of sheets than the end portion on the opposite side of the transfer direction of sheets of the first cut-out portion and wherein the insertion portion extends parallel to an end portion on a forward side of the transfer direction of sheets of the third flat surface portion, and the end portion on a forward side of the transfer direction of sheets of the third flat surface portion is disposed toward the opposite side of the transfer direction of sheets than an end portion on the opposite side of the transfer direction of sheets of the first cut-out portion.

8. The sheet package according to claim 7, the package member further comprising:

a lid base foldably extended from an end portion of the first flat surface portion on an opposite side of the end portion of the first flat surface portion connecting to the third side face portion and covering at least part of the surface on one side in the stacking direction of the stacked sheets;

a rectangular lid side face portion foldably extended from an end portion of the lid base on an opposite side of the end portion of the lid base connecting to the first flat surface portion and covering an end face on a transfer direction side of said stacked sheets; and a lid distal end foldably extended from an end portion of the lid side face portion on an opposite side of the end portion of the lid side face portion connecting to the lid base.

9. The sheet package according to claim 7, the package member further comprising:

a cut portion provided between the first side face portion and the second flat surface portion in a predetermined length.

* * * * *